United States Patent [19]

Wood

[11] Patent Number: 5,046,618

[45] Date of Patent: Sep. 10, 1991

[54] CHILD-RESISTANT BLISTER PACK

[75] Inventor: Anthony J. G. Wood, Nr. Chippenham, Great Britain

[73] Assignee: R. P. Scherer Corporation, Troy, Mich.

[21] Appl. No.: 615,489

[22] Filed: Nov. 19, 1990

[51] Int. Cl.[5] ..... B65D 17/28; B65D 83/04

[52] U.S. Cl. ..... 206/532; 206/484; 206/534.1

[58] Field of Search ..... 206/532, 484, 484.2, 206/524.2, 534.1, 528

[56] References Cited

U.S. PATENT DOCUMENTS

| | | | |
|---|---|---|---|
| 3,835,995 | 9/1974 | Haines | 206/484 X |
| 4,243,144 | 1/1981 | Margulies | 206/532 |
| 4,305,502 | 12/1981 | Gregory et al. | 206/532 |
| 4,506,789 | 3/1985 | Dlugosz | 206/539 X |
| 4,537,312 | 8/1985 | Intini | 206/532 |

*Primary Examiner*—William I. Price

*Attorney, Agent, or Firm*—Allegretti & Witcoff, Ltd.

[57] ABSTRACT

A child-resistant blister pack for fragile single-dosage forms, e.g. a fast-dissolving dosage form ((FDDF) is disclosed. Limited entry points are provided, and completion of a sequence of steps is necessary to access the dosage forms within the depressions. A blister film sheet with depressions for receiving dosage forms is sealed with a lidding sheet and perforated to provide lines of weakness to define single dosage units with a depression containing a dosage form in each dosage unit. Single- or double-entry embodiments are disclosed, allowing access from one or two points on the blister sheet. After tearing along the perforations, a single dosage unit is separated from the blister pack. The user may then access the single-dosage form in the associated single-dosage unit. In a first embodiment, the dosage unit has a tear strip for exposing an unsealed corner, thereby allowing access to the dosage form within by grasping the edge and peeling it off the blister film sheet. In a second embodiment, the unsealed corner is exposed upon separation of the dosage unit from the blister film sheet.

6 Claims, 2 Drawing Sheets

Fig. 1
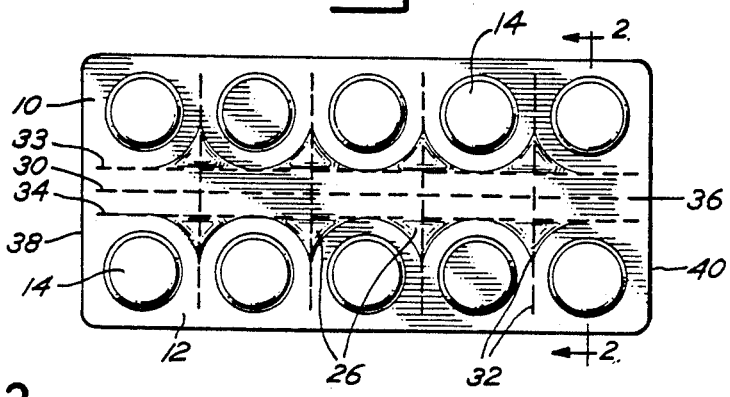
Fig. 2
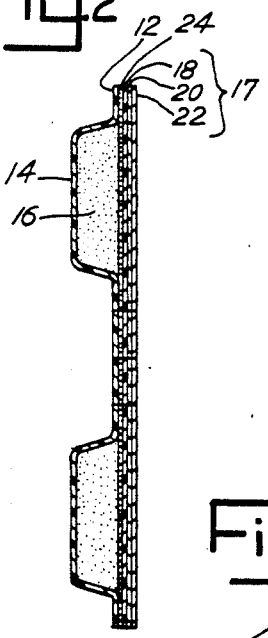
Fig. 3
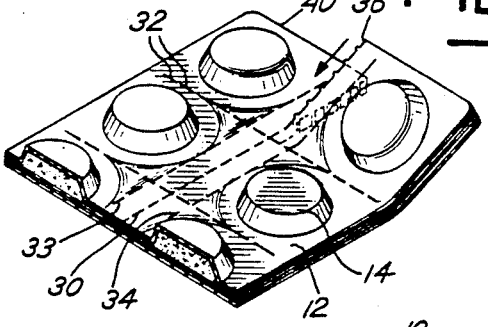
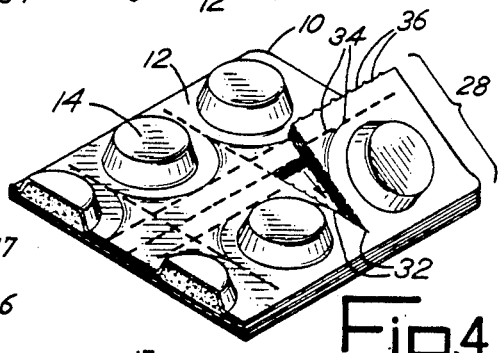
Fig. 4
Fig. 5
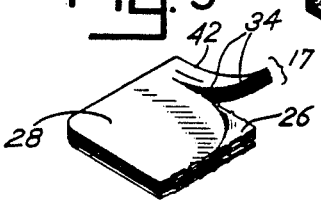
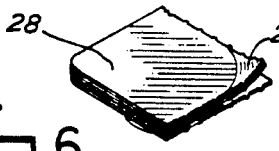
Fig. 6
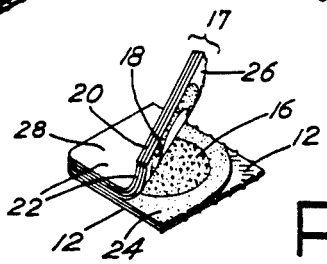
Fig. 7

Fig. 8
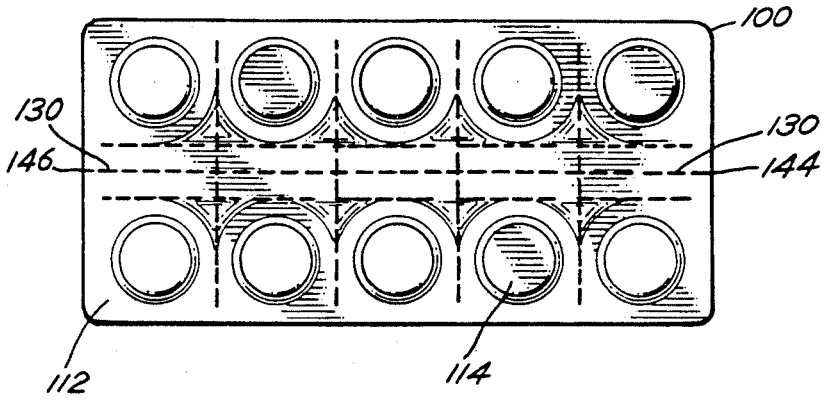
Fig. 9
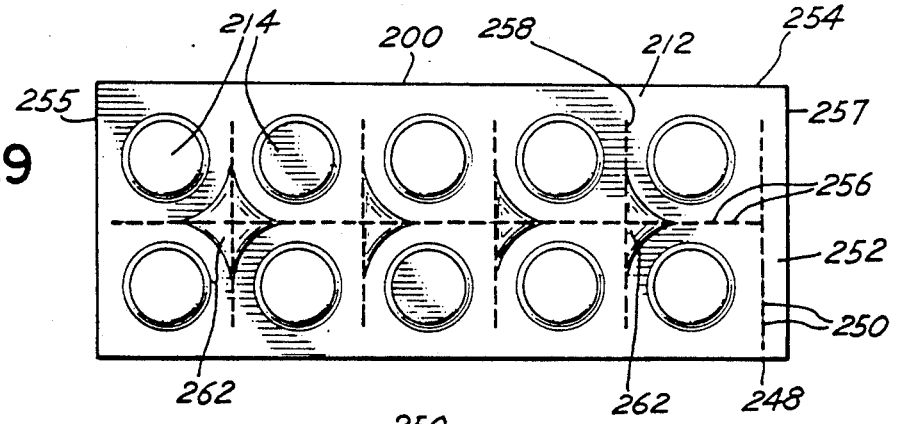
Fig. 10
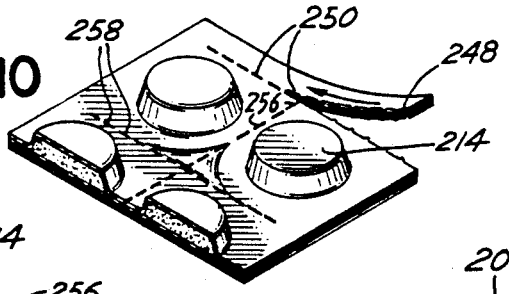
Fig. 12
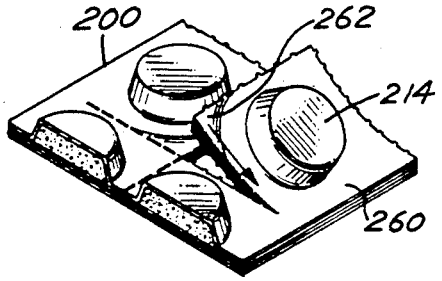
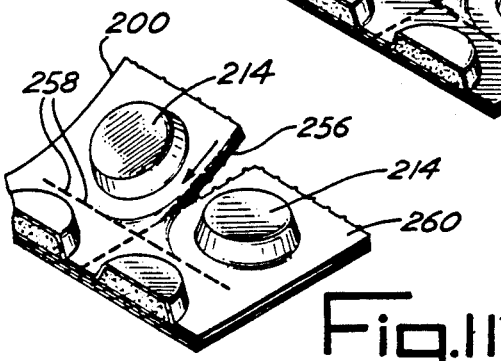
Fig. 11

CHILD-RESISTANT BLISTER PACK

BACKGROUND OF THE INVENTION

The present invention relates generally to packaging of unit-dosage drug formulations, and more particularly in providing a limited-access blister pack that both satisfies the U.S. Poison Prevention Packaging Act regarding child-resistance, and provides a safe, sturdy, and economical package for the transport and dispensing of fast-dissolving dosage form (FDDF) drug formulations.

Recent Federal legislation has been enacted requiring manufacturers to provide child-resistant packaging. The U.S. Poison Prevention Packaging Act was enacted to safeguard uncomprehending children from pharmaceuticals that may pose a danger to them. The marketplace is full of children's formulations that are made to be palatable to them, but with the unfortunate side-effect that this predisposes children to believing that any pills or liquids in bottles will taste good, and not hurt them.

It is desirable to provide a package form that is both easy to use for adults, protective for the pharmaceutical within, and difficult for children to open. The blister pack of the present invention is easy to open for an adult, access being facilitated by entry at one or two points, with a total of four steps necessary to access the drug form within. This method of access is both obvious to an adult, yet inhibitory to a child. The material forming the blister pack is sufficiently strong such that even an adult would have great difficulty in tearing it without utilizing the prearranged scheme for tearing across the perforated, pre-weakened lines. The blister pack is sturdy enough for fragile FDDF drug forms, provides protection from physical stresses, and is also moisture resistant. These considerations are important for pharmaceuticals formed by lyophilization, or freeze-drying. The dosage form may be a capsule, tablet, or the like.

Prior-art child-resistant blister packs have never before combined the advantages present in the present invention. This invention presents a physically tough blister pack, well suited to fragile FDDF drug forms. The invention is also comprised of a water-tight lidding sheet, which must be peeled back to expose the dosage form within. Access to the fragile FDDF drug forms is inhibited to children by allowing for only single- or double-entry points on the blister pack, combined with sequential performance of a number of steps to obtain access to a single dosage form.

There is shown in the prior art various forms of blister packs, none of which embodies all of the features and advantages of the present invention. The Intini reference, U.S. Pat. No. 4,537,312, discloses a tamper-evident, three-layer blister pack, comprised of a blister layer intermediate to an upper layer that is fitted with tabs, and a lower layer with perforated segments located below said tabs on the upper layer. The tabs are provided along the edges for grasping, thereby removing the perforated protective lower layer, allowing the user to access the single dosage units by rupturing the aluminum foil that seals the dosage unit within the intermediate layer. Intini does not disclose the inventive construction and functions in a different fashion, i.e., the user is instructed to push the dosage unit of Intini through the foil, which would damage a fragile FDDF drug form as is protected by the present invention and there is no provision in Intini for limited access to the blister pack as each unit becomes immediately accessible.

Gregory et al., U.S. Pat. No. 4,305,502, relates to a blister pack for fragile freeze-dried chemical or pharmaceutical compositions. It is a two-piece composition, made of an upper plastic blister film with depressions for receiving the dosage forms, and a laminate cover sheet adhered to it. The surface of the cover sheet is scored to allow access to the dosage units within, which are formed in place by freeze-drying. The Gregory package does not provide for sufficient child-resistance, as any one of the units may be accessed by a single procedure. There are multiple entry points, unlike the present invention where there are limited entry points, and a preordained sequence must be executed in order to gain access. Also, the scores are not through the entire pack, as they are in the present invention. Margulies, U.S. Pat. No. 4,243,144, discloses a two-piece bend-and-peel blister strip package. Each dosage unit is divisible by separation along perforations. Access is provided in two steps by pushing down a lower edge strip, then grasping and peeling back the exposed unsealed upper layer. Lines of weakening guide the tearing of the upper layer. Each unit is accessible individually and immediately, unlike the present invention, wherein access is inhibited by the limited number of entry points, and the required completion of the sequential tearing. In addition, access to the unsealed regions is accomplished by different means.

Haines, U.S. Pat. No. 3,835,995, discloses a child-resistant two-piece blister pack in which access is attained in a predetermined manner. A tear strip is removed, revealing a hole in the laminate layer that is used to grasp an unsealed portion of said laminate later, thereby allowing the user to peel back the laminate exposing the dosage form. A limited number of entry points, one per side, is provided. The present invention differs from this reference in that access to the blister pack is enabled by removal of the tear strip, whereas in this reference, access to the individual dosage units is enabled. Also in Haines access is from the edge of the pack after only one preliminary step, as opposed to access after three steps in the present invention.

SUMMARY OF THE INVENTION

The present invention relates to a child-resistant blister-pack, strong enough to protect the fragile FDDF dosage unit against damage and moisture, convenient for individual dosage unit transport, and of limited access, thereby inhibiting opening of the package by children. It is therefore an object of the present invention to provide a blister-pack that offers protection against transportation damage for pharmaceutical formulations and moisture ingress by providing a strong, tear-resistant package, sealed with a lidding sheet that must be removed to access the unit dosage form within.

A further object of the present invention to provide a blister-pack that is portable and easy to use by the adult consumer by allowing individual unit dosage forms to be readily separated from the main blister-film sheet and opened, while providing difficult ingress to the dosage forms for children, said blister pack being easily transported on the person of the consumer.

Another object of the present invention is to provide a blister-pack that meets the requirements of the U.S. Poison Prevention Packaging Act of 1970 for child resistance by providing a multi-step means of access to a tear-resistant package, the number of access points being limited.

Other objects and advantages of the present invention will be made more apparent in the following more detailed description of the invention.

BRIEF DESCRIPTION OF THE DRAWINGS

There is shown in the attached drawing embodiments of the present invention, wherein like numerals in the various views refer to like elements and wherein:

FIG. 1 is a plan view of a first embodiment of the present invention—a blister pack, containing single-dosage units, shown with a single point of access at the right end of said blister pack;

FIG. 2 is a transverse cross sectional view of said blister pack, taken generally along the line 2—2;

FIG. 3 is a perspective view of the blister pack, illustrating a first tearing of a line of weakening, to permit access to a single dosage unit;

FIG. 4 is a perspective view similar to FIG. 3, depicting the second step in accessing a single dosage unit;

FIG. 5 is a perspective view of a single dosage unit separated from the blister film sheet, illustrating tearing of a tear strip to permit access to the dosage form;

FIG. 6 depicts the single dosage unit with an unsealed corner available for access, as occurs after removal of a tear strip;

FIG. 7 depicts the single dosage unit with the lidding sheet peeled back, allowing access to the dosage form;

FIG. 8 is a plan view of a second embodiment of the present invention—a double-entry blister pack similar to FIG. 1, prior to accessing the dosage form within;

FIG. 9 is a plan view of a third embodiment of the invention—a single-entry end-tab blister pack prior to accessing the dosage form within;

FIG. 10 is a partial perspective view of the blister pack shown in FIG. 9, illustrating removal of the tear strip from one end;

FIG. 11 is a partial perspective similar to FIG. 10, illustrating separation of adjacent single dosage units along a longitudinal line of weakening; and FIG. 12 is a partial perspective view similar to FIG. 10, illustrating separation of a single dosage unit from the blister pack along a transverse line of weakening to permit peeling back the lidding sheet to expose a single dosage form.

DETAILED DESCRIPTION OF THE PREFERRED EMBODIMENT

FIGS. 1 through 7 show the preferred embodiment of the present invention—a single-entry, central tab, child-resistant blister pack 10. FIG. 1 depicts a ten unit blister pack, although as shown herein, any commercially practicable number of units may be grouped in a single blister pack. FIG. 2 is a transverse cross sectional view of said blister pack 10, taken generally along the line 2—2. FIGS. 3–7 are illustrative of the sequence of steps necessary to access the unit dosage form located within the depressions 14.

With particular reference to FIGS. 1 and 2, blister pack 10 comprises a blister film sheet 12 having a plurality of depressions 14 extending from the plane of said blister film sheet 12. The blister film sheet 12 may be made of any of a variety of translucent or opaque plastics such as polyvinyl chloride (PVC), PVC and PVdC (polyvinyl dichloride), polythylene PVC/PVdC/ polyethylene and PVC/Aclar. Within each depression 14 is a unit dosage form 16. The dosage form 16 may be a preselected quantity of a pharmaceutical prepared by lyophilization (freeze-drying), resulting in a fast-dissolving dosage form (FDDF) that may be fragile. Conventional dosage forms such as capsules, tablets, etc., may also easily be contained within the depressions. The unit dosage forms 16 are retained within the depressions 14 by a laminated lidding sheet means 17. The lidding sheet means 17 is generally comprised of polyester laminates, aluminum foil, aluminum/ester laminates, paper, paper/aluminum laminates, and other related materials. Polymer layer 18 adds strength, thereby deterring tearing of the aluminum layer 20, next to the polymer layer 18. The aluminum layer 20 acts as the primary barrier for safeguarding the dosage form within. Paper layer 22 is an optional layer, although it is included in the preferred embodiment. It adds further strength to the lidding sheet means 17, and allows print to be placed on the blister pack. The lidding sheet means 17 is bonded to the blister film sheet 12 by means of an adhesive layer 24. Any of a variety of adhesives well-known in the art may be used. Bonding of said lidding sheet means 17 to said blister film sheet 12 occurs such that the depressions are sealed, with selected portions 26, away from the depressions, left unsealed.

In the preferred embodiment, gaining access to the unit dosage form 16 within each dosage unit 28 is accomplished by a sequence of actions performed upon the blister film pack 10, and then upon the individual dosage unit 28. This sequence is illustrated in FIGS. 3–7. The first step is shown in FIG. 3. First, second, third, and fourth lines of weakening 30, 32, 33, 34, are provided in the preferred embodiment. Lines 30, 32, 33, 34 are perforations through the blister pack 10. A first tear is made in the direction of the arrow at the single-entry access point 36, along the first line of weakening 30, located between said rows of depressions 14 and extending substantially from side to side of said blister pack 10, but short of the far edge 38. The single-entry access point 36 is defined where the firt line of weakening 30 extends to the near edge 40 of blister film sheet 12. In this first tearing step, the tear proceeds to the first intersection of perpendicular lines of weakening 32 and 36. FIG. 4 depicts the second step, a second tear made along the perforations 32 in the direction of the arrow shown in FIG. 4, commencing at the aforesaid intersection lines 32 and 36, and resulting in the separation of the single dosage unit 28 from the blister pack 10 by tearing through the edge of said pack 10.

With reference to FIG. 5, a third tear is made in the direction of the arrow in FIG. 5 along a third line of weakening 34, terminating with removal of the tear strip 42. This exposes unsealed portion 26 so that it may be grasped by the user (see FIG. 6).

The final step is shown in FIG. 7, peeling the unsealed corner 26 of the lidding sheet means 17 back and away from blister film sheet 12 to reveal the unit dosage form 16.

In a second embodiment of the invention, depicted in FIG. 8, the first line of weakening extends from edge to edge of said blister pack 100 to define a double-entry access. The initial entry may be made at either edge of the blister film sheet at points 144 or 146. In other respects, the construction of FIG. 8 is the same as that of the embodiment of FIGS. 1–7.

In the third embodiment of the invention depicted in FIG. 9, there is shown a blister pack 200 containing ten unit dosage forms. Entry is accomplished through a single-entry access point 248, comprising a first line of weakening 250 defining an end tab 252 of said blister film sheet 212. The first line of weakening 250 starts at point 248, and terminates short of the opposing edge 254. A second line of weakening 256 is perpendicular to and intersects said first line 250. The second line 256 passes each depression 214, and originates and terminates short of the edges 255 and 257 of said sheet. The first step of accessing the unit dosage forms is shown in FIG. 10, wherein a tear is made as shown by the arrow starting at across, point 248 and continues along the first line of weakening 250 until the end tab 252 at least passes the second line of perforations 256. A tear is then made along the second line of weakening 256 to the intersection with the third line of weakening 258 (FIG. 11). Detachment of the single dosage unit 260 is accomplished by tearing along the third line of weakening 258 as shown by the arrow in FIG. 12 until separation is complete. Access to the unit dosage form 16 is then accomplished by grasping the exposed unsealed portion 262 and separating FIG. 12 and 7.

There has been provided by the present invention a unique blister pack that is child resistant, safe, sturdy and economical. The blister pack is in compliance with existing U.S. safety standards, for example, the U.S. Poison Prevention Packaging Act.

While I have shown presently preferred embodiments of the present invention, it will be understood that the invention is not limited thereto, but that changes and modifications may be made within the scope of the invention, which is limited only by the scope of the appended claims.

What is claimed is:

1. A child-resistant blister pack for enclosing one or more unit dosage forms, comprising in combination:

a blister film sheet having one or more depressions extending from the plane of said blister film sheet, each depression being adapted to receive a unit dosage form, and said depressions arranged substantially linearly;

a lidding sheet for sealably enclosing a unit dosage form within each said depression area;

means for attaching said blister film sheet to said lidding sheet, while avoiding attachment to said depressions, thereby sealing each said unit dosage form within a selected depressions;

entry access means, comprising a first line of weakening located between said rows of depressions and extending substantially from side to side of said blister pack, but short of the edge;

a dosage unit containing one depression, each depression formed within a dosage unit defined by additional lines of weakening, said additional lines terminating short of the edge of said blister pack, said additional lines being substantially transverse to said first line, at least one corner of each said dosage unit having an unsealed portion between said lidding sheet and said blister film sheet, said unsealed portion being separate from said depression; and each dosage unit including a tear strip, defined by a third line of weakening, said third line starting at an interior corner of said unit and extending across a portion of said unit, but terminating short of an edge of said blister pack, thereby exposing for grasping an unsealed corner region of said lidding sheet upon removal of said tear strip.

2. A child resistant blister pack as in claim 1 wherein said first line of weakening extends from one edge beyond the depression closest to the opposite edge, but short of the opposite edge to define a double entry access.

3. A child resistant blister pack as in claim 1 wherein said first line of weakening extends from edge to edge of said blister film sheet to define a double entry access.

4. A child resistant blister pack as in claim 1 including a polymer layer secured to said lidding sheet for additional strength for said lidding sheet.

5. A child resistant blister pack as in claim 2 or 3 wherein said first line of weakening is substantially midway between said rows of depressions.

6. A child-resistant blister pack for enclosing one or more unit dosage forms, comprising in combination:

a blister film sheet having one or more depressions extending from the plane of said blister film sheet, each depression being adapted to receive a unit dosage form, and said depressions arranged substantially linearly;

a lidding sheet for sealably enclosing a unit dosage form within each said depression area;

means for attaching said blister film sheet to said lidding sheet, while avoiding attachment to said depressions, thereby sealing each said unit dosage form within a selected depression;

single-entry access means, comprising a first line of weakening defining an end tab of said blister film sheet, said first line starting at one edge of an end of said blister film sheet and terminating short of the opposing edge, and a scond line of weakening perpendicular to and intersecting said first line, said second line passing each blister, and originating and terminating short of the edges of said sheet; and a dosage unit containing one depression, each depression formed within a dosage unit defined by a third line of weakening, said third line terminating short of the edge of said blister film sheet, said third line being substantially perpendicular to said second line, at least one corner of each said dosage unit having an unsealed portion between said lidding sheet and said blister film sheet, said unsealed portion being separate from said depression.

* * * * *